United States Patent [19]

Williams

[11] 4,264,791

[45] Apr. 28, 1981

[54] DEVIOUS PATH ROTARY SWITCH

[76] Inventor: Robert A. Williams, 2721 White Settlement, Fort Worth, Tex. 76107

[21] Appl. No.: 15,291

[22] Filed: Feb. 26, 1979

[51] Int. Cl.[3] ..... H01H 9/00

[52] U.S. Cl. ..... 200/4; 200/11 D; 200/14

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 14, 17 R, 17 A, 17 B, 18, 15, 4

[56] References Cited

U.S. PATENT DOCUMENTS

| | | | |
|---|---|---|---|
| 2,982,824 | 3/1961 | Forrest | 200/14 X |
| 3,211,845 | 10/1965 | Zoltai | 200/4 |

*Primary Examiner*—J. V. Truhe
*Assistant Examiner*—Morris Ginsburg
*Attorney, Agent, or Firm*—Arthur F. Zobal

[57] ABSTRACT

A rotary switch comprising a body supporting a shaft and a plurality of spaced apart stationary contacts located around the shaft. The shaft is supported for axial and rotary movement and carries a contact means for engaging the stationary contacts as the shaft is rotated to different angular positions. A stop fixedly supported by the body and a disc connected to the shaft and having two sets of teeth located in two different planes are provided for requiring the shaft to be moved axially and angularly in order to allow it to be rotated to the different angular positions for causing the contact means to engage the stationary contacts.

5 Claims, 12 Drawing Figures

Fig. 1
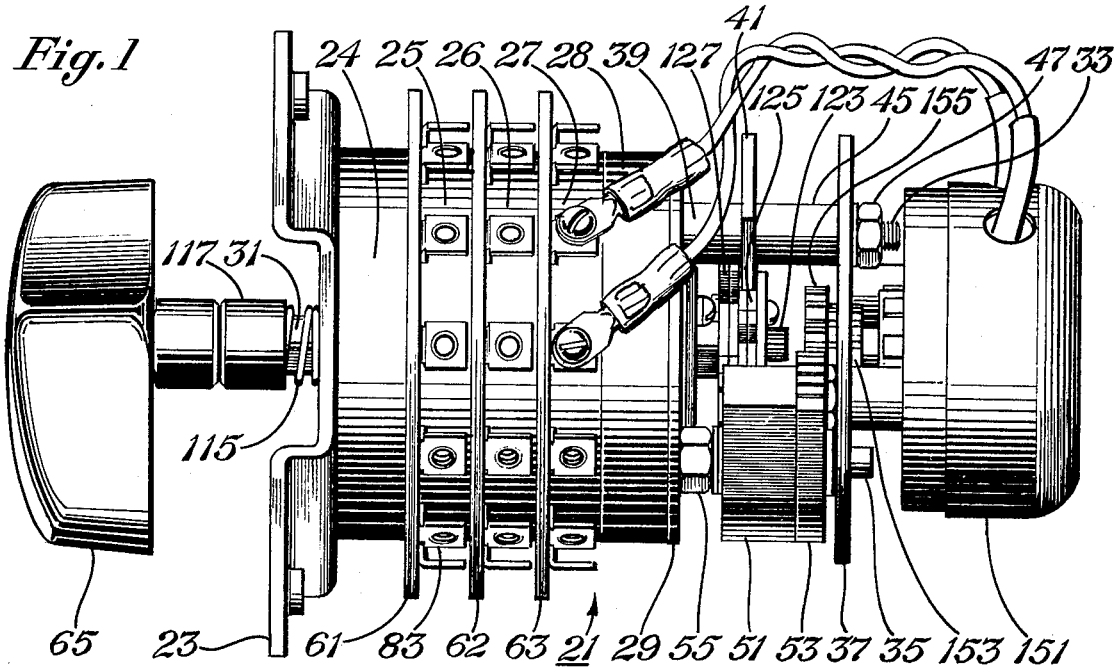
Fig. 7
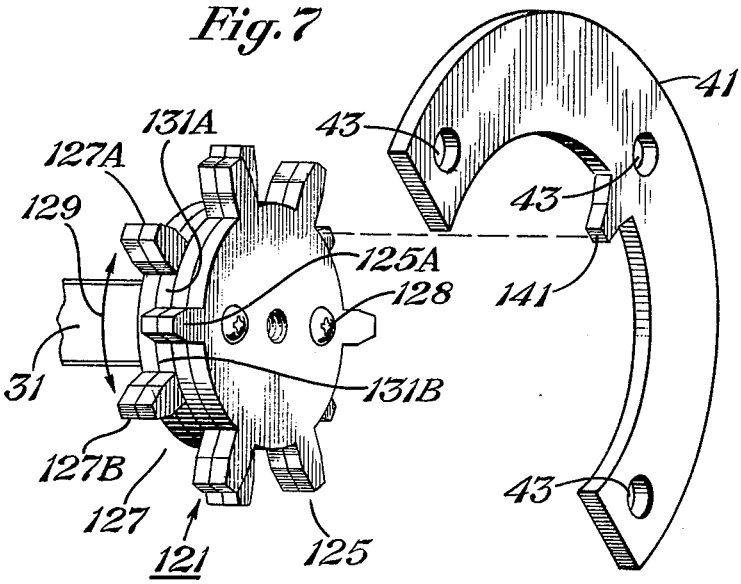
Fig. 8
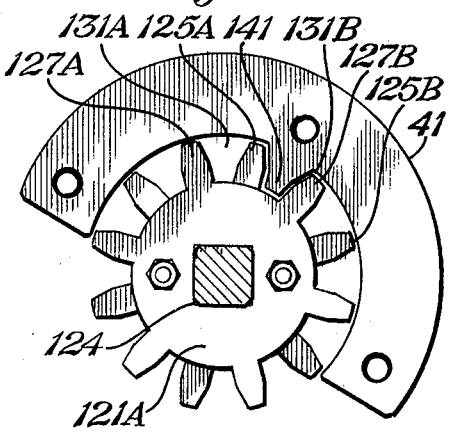
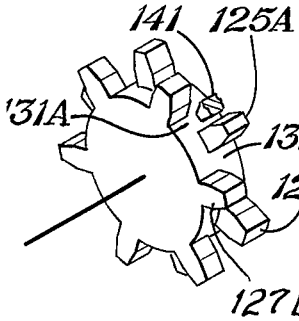
Fig. 9
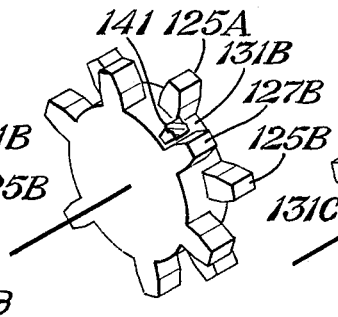
Fig. 10
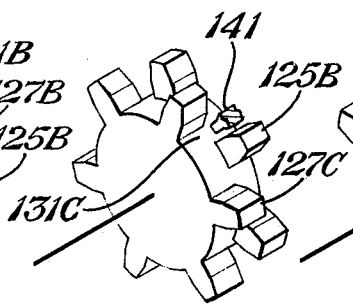
Fig. 11
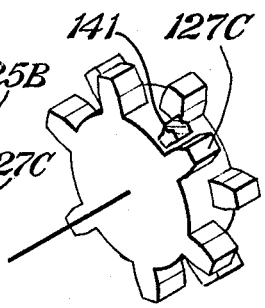
Fig. 12

Fig. 2
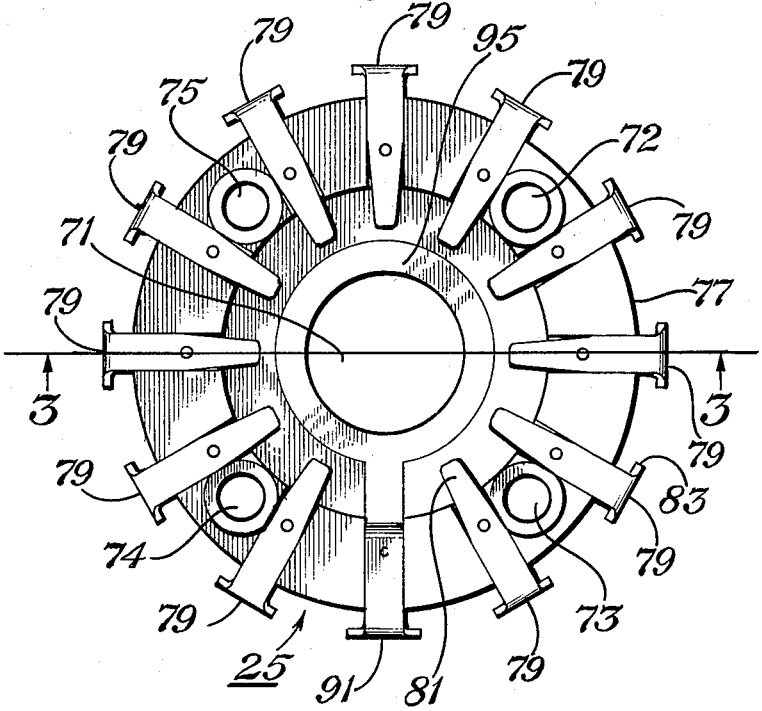
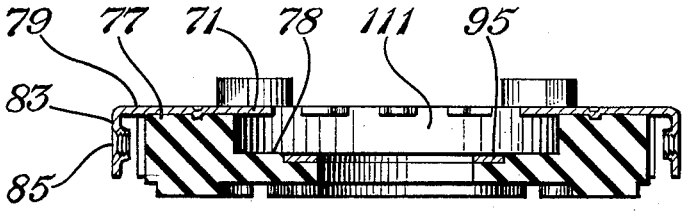
Fig. 3
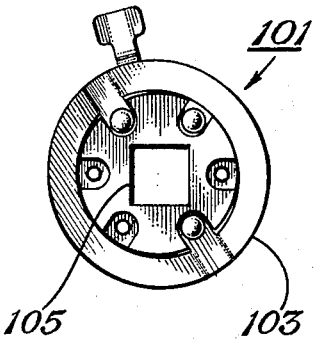
Fig. 4
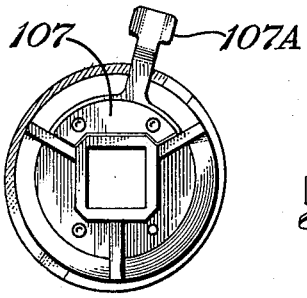
Fig. 5
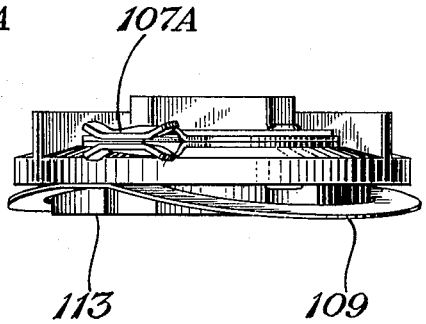
Fig. 6

DEVIOUS PATH ROTARY SWITCH

BACKGROUND OF THE INVENTION

1. Field of the Invention

The present invention relates to a rotary switch and more particularly to structure for slowing down the operation of a rotary switch.

2. Description of the prior art

In electro hydraulic transmissions, solenoid operated valves are switched by a rotary switch for operating the system. If the rotary switch is operated too fast, the solenoid valves cannot keep up with the switching operation which may result in damage to the transmission.

SUMMARY OF THE INVENTION

It is an object of the present invention to provide structure in a rotary switch to slow down the switching operation of the switch.

It is a further object of the present invention to provide a rotary swtich having structure which requires its shaft to follow an axial and angular path in order to slow down the switching operation.

BRIEF DESCRIPTION OF THE DRAWINGS

FIG. 1 is a side view of a rotary switch incorporating the present invention.

FIG. 2 is a plan view of one of the wafers of the switch of FIG. 1 illustrating its stationary contacts.

FIG. 3 is a cross-sectional view of the wafer of FIG. 2 as seen along the section line 3—3 thereof.

FIG. 4 is a plan view of one side of a wiper member employed for engaging the contacts of the wafer of FIG. 2.

FIG. 5 is a plan view of the other side of the member of FIG. 4.

FIG. 6 is an end view of the wiper member of FIGS. 4 and 5.

FIG. 7 illustrates a disc with two sets of teeth and a stop which are employed in the switch of FIG. 1 for slowing down its switching operation.

FIG. 8 is an end view of the disc and stop of FIG. 7 as seen from the left.

FIGS. 9–12 illustrate different positions of the disc of FIGS. 7 and 8 with respect to the stop.

DESCRIPTION OF THE PREFERRED EMBODIMENT

Referring now to FIGS. 1–6, reference numeral 21 identifies a rotary switch in which the present invention is incorporated. The switch comprises a base 23 having secured thereto five annular disc like wafers 24–28 and an annular plate 29. Each of the wafers 24–28, base 23, and plate 29 has a center aperture formed therethrough for receiving a shaft 31 and four apertures spaced radially from the center for receiving four securing rods, two of which are identified at 33 and 35. The four rods also extend through four apertures formed through annular plate 37. The plate 37 is spaced from plate 29 by hollow cylindrical spacers 39 located around three of the rods (one of the three rods is shown at 33), an arcuate shaped member 41 having three apertures 43 through which the three rods extend, and hollow cylindrical shaped spacers 45 located around the three rods. The three rods have their opposite ends threaded to which nuts are secured on the outside of base 23 and plate 37 for holding the assembly together. One nut is shown at 47. The fourth rod 35 has a smooth surface at its end between plates 29 and 37 for rotatably supporting a V-shaped ratchet member 51 and gear member 53 fixedly secured to the ratchet member. The rod 35 is threaded from the ratchet member 51 to its other end extending beyond base 23 for receiving two nuts on the outside of base member 23 and plate 29. One of these nuts is shown at 55.

Wafers 24–25 are formed of electrically insulating material. Members 61–63 are electrically insulating ring shaped spacers located between wafers 24–25, 25–26 and 26–27 respectively and around the four securing rods.

Each of wafers 25–27 has a plurality of spaced apart electrical contacts adapted to be sequentially engaged by an associated wiper contact member carried by the shaft 31 as the shaft is rotated by manually turning a knob 65 attached to the end of the shaft 31 extending beyond base 23.

Referring to FIGS. 2–6, wafer 25 and its associated wiper member will be described. The other wafers 26 and 27 and their wiper members are the same. As shown in FIG. 2, wafer 25 has a central aperture 71 for receiving the shaft 31 and four apertures 72–75 for receiving the four securing rods. A raised annular ridge 77 is formed on one side spaced outward from the aperture 71 for supporting eleven contacts 79. The inner ends 81 of the eleven contacts 79 extend inward of the ridge 77 and overhang the lower portion 78 of the wafer. The outer ends of the contacts terminate in transverse end portions 83 which are parallel to the peripheral edge of the wafer. Ends 83 have threaded apertures 85 formed therethrough for receiving connecting bolts for connecting electrical leads to the contact. Contact member 91 is a common contact which is secured to ridge 77. It follows the inner surface of the ridge 77 down to the lower inner portion 78 of the wafer and then to a ring 95 secured to the lower inner portion 78 around the aperture 71. Contact 91 has a transverse end similar to ends 83 with a threaded aperture formed therethrough for receiving a connecting bolt for connecting an electrical lead thereto.

The wiper assembly for wafer 25 is identified at 101. It comprises a member 103 formed of electrically insulating material and has a square shaped aperture 105 formed therethrough for slidingly receiving the shaft 31 which also is square in cross-section. When the shaft 31 is rotated, it rotates the wiper assembly 101. A metalic wiper member 107 secured to one side of member 103 has a two layer arm 107A which extends outwardly for engaging contacts 79 as the shaft 31 is rotated. The wiper arm 107A cannot directly engage contact 91 as the wiper is rotated. A ring shaped metalic spring member 109 is secured to the other side of member 103 and engages the ring 95 when the wiper assembly is fitted in place in the cavity 111. When fitted in place, the annular extension 113 fits in aperture 71 and acts as a shaft as the wiper assembly is rotated. A rivet (not shown) extends from wiper member 107 to spring member 109 through the member 103 securing wiper member 107 and spring 109 together and providing electrical contact between the wiper member 107 and spring 109. The curvature of the spring ring 109 ensures that electrical contact is had between the rings 109 and 95.

As can be understood, if the shaft 31 is rotated at a fast rate, the wiper arms 107A of wafers 25–27 will sequentially engage their associated contacts 79 at a fast rate. If the switch 21 were used to switch the solenoid operated valves of an electro hydraulic transmission, this may cause problems as indicated above.

As now will be described, structure is provided for requiring the shaft 31 to follow a devious path for slowing down the rate at which it can be rotated. The shaft 31 is allowed to move axially in opposite directions a limited amount. As stated above, the square apertures 105 of the wiper assemblies 101 slidingly receive the shaft 31. Since the wiper assemblies are sandwiched in the cavities 111 of the wafers with their annular extensions 113 located in the apertures 71 of the wafers, the operation of the wiper assemblies are not affected by axial movement of the shaft 31 through the wiper assemblies. A spring 115 surrounds the shaft 31 and seats against base 23 and a stop 117 (which also surrounds the shaft 31) for urging the shaft 31 to the axial position shown in FIG. 1 (to the left as shown in FIG. 1).

Referring also to FIGS. 7 and 8, a disc member 121 is attached to the opposite end of the shaft 31 by a bolt 123. As shown in FIG. 8, a square aperture 124 is formed on the side 121A of the disc which receives the tip end of the shaft 31 to prevent the disc from rotating relative to the shaft.

The disc member 121 has two sets of teeth 125 and 127 located in different planes. Each set is identical and has six angularly spaced apart teeth. All of the teeth are identical and the teeth of each set are equally spaced apart. As shown, each set is made up of two layers although a single thick layer for each set of teeth could be employed. The two sets of teeth are fixedly attached together by bolts 128.

As shown in FIG. 8, each tooth of each set is located in alignment with the space between adjacent teeth of the other sets such that a slot parallel with the axis of the shaft exists between each tooth of each set and an adjacent tooth of the other set. For example, tooth 125A is located in alignment with the midpoint of the space 129 between teeth 127A and 127B defining slot 131A between adjacent teeth 127A and 125A and slot 131B between adjacent teeth 125A and 127B. All of the slots are equal to dimensions and have a size sufficient to freely receive a stop 141 extending radially inward from arcuate shaped plate 41. When any of the slots of the disc are in alignment with the stop 141, the shaft 31 may be moved axially to place either set of teeth 127 or 125 in the plane of the stop 141. In FIG. 1, the set of teeth 125 is in the plane of the stop 141. The other set of teeth 127 may be positioned in the plane of the stop 141 by moving the shaft 31 axially to the right (as seen in FIG. 1) when one of the slots of the disc is in alignment with the stop 141.

When either set of teeth is in the plane of the stop 141, the stop limits rotational movement of the disc 121 and hence of the shaft 31. For example, referring to FIG. 8 and assuming that the set of teeth 127 is in the plane of stop 141, the disc 121 may be rotated from the position shown clockwise (of FIG. 8) until stop 141 engages tooth 127A.

With the structure as described above, the shaft may be rotated to allow the wiper arm 107A to sequentially engage a plurality of the contacts 79, however, the shaft must also be moved axially to alternately place the two sets of teeth 125 and 127 in the plane of the stop 141. For example, referring to FIG. 9, the set of teeth 125 is located in the plane of the stop 141. Assume that it is desired to rotate the disc 121 counterclockwise. In the position shown, tooth 125A will prevent counterclockwise movement of the disc. The shaft 31 and hence disc 121 must be moved axially forward with stop 141 in slot 131A to locate the set of teeth 127 in the plane of the stop. When this is done, the disc 121 can be rotated counterclockwise until stop 141 engages tooth 127B as shown in FIG. 10. At this point, the shaft 31 and hence disc 121 must be moved axially rearward with the stop 141 in slot 131B to locate the set of teeth 125 in the plane of the stop 141. When this is done, the disc can be rotated counterclockwise until stop 141 engages tooth 125B as shown in FIG. 11. At this point, the shaft 31 and hence disc 121 must be moved axially forward with stop 141 in slot 131C to locate the set of teeth 127 in the plane of the stop. The disc can then be rotated counterclockwise until stop engages tooth 127C as shown in FIG. 12. Thus as can be understood, for the shaft to be rotated to allow the wiper arm to engage all of the contacts 79, the shaft must be moved angularly in a given direction, axially in one direction, angularly in the desired given direction, axially in a second direction opposite to said one direction, angularly in the desired given direction, etc. The resulting devious path that the shaft must follow slows down rotation fo the shaft allowing sufficient time for the solenoid operated valves of an electro hydraulic transmission to keep up with the switching action of the switch 21.

Axial movement of the shaft 31 is limited by the end of stop 117 and a pin (not shown) extending through the shaft on the inside of base 23.

Member 151 is a solenoid for actuating the ratchet member 51 through gears 153, 155, and 53 for moving the ratchet member 51 into one of the slots of the discs 121 for stopping rotation of the disc.

Although the switch 21 is employed for switching the solenoid operated valve of an electro hydraulic transmission, it is to be understood that it may be used for other purposes.

What is claimed is:

1. A rotary swtich comprising:

a body supporting a plurality of spaced apart stationary contacts located along a circle, a shaft supported for rotation by said body and carrying a contact means for contacting said stationary contacts as said shaft is rotated, said shaft being supported for axial movement relative to said body, structure requiring said shaft to follow a given path in order to be rotated to different angular positions for allowing said contact means to sequentially contact a plurality of said stationary contacts, said given path comprising:

(a) an angular path in a given angular direction at a first axial position, (b) a path parallel with the axis of said shaft in a first axial direction to a second axial position, (c) an angular path in said given angular direction at said second axial position, and (d) a path parallel with the axis of said shaft in a second axial direction opposite to said first axial direction to said first axial position.

2. The rotary switch of claim 1 wherein said structure comprises:

stop means fixedly supported by said body, disc means connected to said shaft and having two sets of teeth located in two different planes along the length of said shaft, said two sets of teeth and said stop means cooperating together to require said shaft to follow said given path in order to be rotated to said different angular positions.

3. A rotary switch comprising:

a body supporting a plurality of spaced apart stationary contacts located along a circle, a shaft supported for rotation by said body and carrying a contact means for contacting said staionary contacts as said shaft is rotated, disc means connected to said shaft and having two sets of teeth located in two different planes along the length of said shaft, each set of teeth comprising a plurality of angularly spaced apart teeth, one tooth of each set being located in alignment with the space between adjacent teeth of the outer set such that a slot parallel with the axis of said shaft exists between each tooth of each set and an adjacent tooth of the other set, said shaft and hence said disc means being supported for axial movement relative to said body, stop means fixedly supported by said body and having a size such that the slot between each tooth of each set and an adjacent tooth of the other set may receive said stop means to allow said disc means to be moved axially to position either set of teeth in the plane of said stop means, said stop means when in the plane of either set of teeth being located between adjacent teeth of said set and in their path of rotation to limit the amount of rotation of said disc means and hence of said shaft.

4. The rotary switch of claim 1, wherein:

said structure comprises structural means coupled to said shaft and movable axially and angularly with said shaft and structural means fixedly supported by said body.

5. The rotary swtich of claims 1, 2 or 4, wherein:

said shaft is slidable relative to said contact, means when it is moved to said first or second axial positions, said rotary switch comprising support means for maintaining said contact means in a given plane generally perpendicular with the axis of said shaft when said shaft is in said first or second positions, said support means allowing said contact means to be rotated in said given plane by said shaft for contacting said stationary contacts when said shaft is in said first or second axial positions.

* * * * *